United States Patent [19]

Singer et al.

[11] Patent Number: 4,768,439

[45] Date of Patent: Sep. 6, 1988

[54] FLARE COMPOSITION AND FLARE COMPRISING SAID COMPOSITION

[76] Inventors: Stewart M. Singer, 1800 Elsinore Rd., Riverside, Calif. 92506; Stanley Fitzgerald, 7721 San Diego Ave., Rancho Cucamonga, Calif. 91730

[21] Appl. No.: 113,015

[22] Filed: Oct. 23, 1987

[51] Int. Cl.[4] ..... B41K 1/48; C06B 31/10

[52] U.S. Cl. ..... 102/336; 149/71; 149/82

[58] Field of Search ..... 102/336; 149/71, 82

[56] References Cited

U.S. PATENT DOCUMENTS 3,865,035 2/1975 Munson et al. ..... 102/66
3,895,578 7/1975 Shaw et al. ..... 149/15 X
4,149,916 4/1979 Wade ..... 149/56
4,341,573 7/1982 Donoho ..... 149/71 X

*Primary Examiner*—Peter A. Nelson
*Attorney, Agent, or Firm*—Darby & Darby

[57] ABSTRACT

An illuminating non-metallic pyrotechnic composition is disclosed which consists essentially of, expressed in absolute weight units: (a) from about 51 to 61 parts of strontium nitrate, (b) from about 15 to 25 parts of potassium perchlorate, (c) from about 15 to 25 parts of sulfur, (d) about 3 parts of sodium nitrate, and (e) about 2 parts of uintaite. Optimum flare luminosity is achieved when the composition is essentially free of other fuel constituents, such as dextrin, nitrocellulose charcoal. A flare is disclosed comprising the disclosed pyrotechnic composition.

19 Claims, 1 Drawing Sheet

FLARE COMPOSITION AND FLARE COMPRISING SAID COMPOSITION

BACKGROUND OF THE INVENTION

The present invention relates to illuminating pyrotechnic compositions, particularly those in signal or distress flares, and to signal flares and the like comprising such compositions. More specifically, the invention relates to a class of flare compositions known generally as non-metallic flare compositions, denoting the absence of particulate metals such as magnesium or aluminum from such compositions, and signal or distress flares comprising such compositions.

Signal or distress flares are generally known devices for providing illumination in the event of emergencies, such as the occurrence of an automobile accident or airplane or rail crash. Signal flares are also used by lost persons in order to attract searchers toward them, such as occurs in boating or hiking accidents occurring at night, or even during daylight hours. Signal flares may be also be used for a wide variety of other purposes, such as temporary illumination of a runway, or as part of fireworks displays.

Flare compositions may include brightly burning particulate metals, such as aluminum or magnesium powder, but the temperature of the combustion reaction of such metallic flare compositions is extremely high, thus increasing the risks of using such flares. In addition, metallic flare compositions burn much faster than non-metallic compositions, thus reducing their attractiveness where a sustained signal is desired. Metallic flare compositions also produce metallic ash, or "clinker," when burning, which then drops from the flare as it continues to burn, creating an unacceptable risk of causing fire in many applications where signal flares are most useful.

Cooler burning non-metallic flare compositions are generally known, having reduced risk of causing burns or fires caused by the flare itself, but flare brightness is reduced with respect to similarly sized flares comprising metallic compositions.

Thus there is a need for a brighter burning non-metallic flare composition in order to produce smaller flares without sacrificing brightness. Also, there is a need for brighter non-metallic flares of conventional size.

OBJECTS AND SUMMARY OF THE INVENTION

It is therefore a general object of the present invention to provide an improved flare composition which burns brighter than known non-metallic signal flare compositions, yet which does not burn as hot as metallic compositions and which does not produce hot ash which might cause additional fires.

It is an object to provide a brighter non-metallic flare for a given flare size, or alternatively stated, a smaller flare capable of producing equal brightness to larger currently known non-metallic flares.

The improved flare composition according to the invention comprises, expressed in absolute weight units, from about 51 to 61 parts of strontium nitrate, from about 15 to 25 parts of potassium perchlorate, from about 15 to 25 parts of sulfur, about 3 parts of sodium nitrate, about 2 parts of uintaite, a gas-generating agent, and about 1 to 1½ parts of a conventional anti-dusting agent such as No. 1 diesel, which is baked off during manufacture of the composition or article comprising the composition.

Other objects and advantages of the present invention will become readily apparent by the following detailed description, read in conjuction with the accompanying drawings.

DESCRIPTION OF THE PREFERRED EMBODIMENTS

Figure 1:
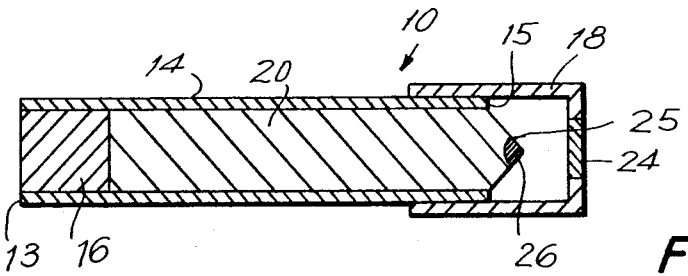
FIG. 1 is a longitudinal sectional view of a preferred embodiment of the present invention.

Referring now to FIG. 1, a flare 10 comprising an improved pyrotechnic composition 20 is shown. More specifically, the flare 10 may comprise, as is typical, a cylindrical paper tube 14 closed at its rearward end 13 by a plug 16 which may be made of wood or plastic or the like. In some manner, such as by gluing, the plug 16 seals the rearward end 13 of the flare 10 to form a sturdy watertight closure. At the opposite, or forward, end 15 of the flare 10, a fitted cap 18 is mounted so as to form another watertight seal thus completely protecting the composition 20 from inadvertent wetting. The cap 18 generally includes a centrally positioned striker means 24 for causing a spark when scraped or scratched along a rough surface, such as concrete or a rock. The striker means 24 is generally positioned adjacent a primer material 26 affixed or set into the forwardmost tip 25 of the pyrotechnic composition 20, so that sparks caused by scraping the striker means 24 will ultimately cause the pyrotechnic composition 20 within the paper tube 14 to ignite. Different configurations of the cap 18 are disclosed in, for example, U.S. Pat. Nos. 4,380,957 and 3,530,795.

In efforts to improve the brightness or intensity of the combustion of non-metallic flare compositions, workers skilled in the art have tried to add other substances to or vary the proportions of many different known flare compositions. Such added materials included higher energy binders and additional fuel components, including dextrin, nitrocellulose, wood meal, charcoal, and various lacquers and gums, but all without achieving any markedly substantial improvement in flare brightness.

Uintaite, a high grade hydrocarbon, also called asphaltum, has been used in metallic flare compositions as a coating agent for the magnesium or copper powder, as disclosed in U.S. Pat. Nos. 4,164,186 and 3,960,087. Uintaite is also known by its trademarked name "GILSONITE." Because the combustion temperature of a metallic flare is so high and the burn intensity so great, uintaite has not before been recognized as a factor in markedly improving flare performance. In attempting to develop an improved non-metallic flare composition, however, the inventors have discovered that the use of uintaite in doping quantities only, in the absence of other generally added fuel components such as charcoal, dextrin and nitrocellulose, provides substantial and unexpected improvements in flare burn intensity and ease of manufacture. Other unexpected properties of the novel composition, such as ignition at low temperature coupled with a high degree of stability, have also been discovered.

The invention was discovered while attempting to determine the effect of varying the proportions of commonly used flare composition components such as dextrin and nitrocellulose. While including uintaite as an intended binder agent, a test was done to determine the "baseline" performance of a composition containing neither dextrin nor nitrocellulose, nor any other conventional additives. Serendipitously, the flare composition provided a markedly improved flame, both in luminosity and reduced solid combustion products. Further attempts to improve the composition by adding greater quantities of uintaite only reduced the brightness of the flame. Adding back additional fuel components or higher energy binders also surprisingly reduced the flare brightness.

While the mechanism of the combustion reaction is not precisely known, it is believed that doping quantities of uintaite may perform as a gas generator, expanding the flame into a well-defined plume and also possibly ejecting intermediate combustion products out into the formed plume. In U.S. Pat. No. 4,078,954, issued to C. Bernardy, the beneficial effects of including a gas generating compound in a flare composition are recognized, but Bernardy discloses that the gas generating agent must necessarily be an organic compound containing at least one carbon-nitrogen bond, and preferrably comprises at least two carbon-nitrogen bonds, at least one carbon-nitrogen heterocyclic ring, at least one multiple bond between a carbon atom and a nitrogen atom and/or only contains carbon atoms which are chemically linked to atoms other than carbon. Contrary to Bernardy's teaching, the present invention employs uintaite, a simple high grade hydrocarbon, as the gas generating component. Uintaite, or asphaltum, is a naturally occuring hydrocarbon deposit found in Utah, United States, and elsewhere to a lesser extent.

An improved flare according to the invention comprising a $\frac{7}{8}$ inch outside diameter paper tube provides a flame of approximately 600–700 candela; 1 inch tube, approximately 1000 candela; $1\frac{1}{4}$ inch tube, approximately 2000 candela.

A preferred flare composition comprises the following components, in the indicated approximate absolute weights (not expressed as percentages of the total weight):

| | |
|---|---|
| $Sr(NO_3)_2$ | 56 parts |
| $KClO_4$ | 20 parts |
| S | 20 parts |
| $NaNO_3$ | 3 parts |
| uintaite | 2 parts |

About 1 to $1\frac{1}{2}$ parts of a conventional anti-dusting agent, such as No. 1 diesel, is preferrably added to control dust during flare manufacture. This anti-dusting agent is subsequently baked off during a conventional drying process.

Strontium nitrate, a stable inorganic combustion supporting agent, produces a red flame. Other alkali metals or alkaline earth metal nitrates are also used in non-metallic flare compositions in order to produce other flame colors. Such compounds include lead nitrate, potassium nitrate, copper nitrate, and barium nitrate. Sodium nitrate may be used as the primary coloring agent as well. Due to the different heats of combustion of the compounds, the percentages of the remaining constituents may vary from those expressly disclosed herein.

Also surprisingly, the burn performance of the composition according to the invention is not appreciably affected by changes of up to ±5 parts of any of the strontium nitrate, potassium perchlorate and sulfur components, thus improving the ease of manufacture, because relative measures of the larger percentage components need not be critically controlled. On the other hand, increasing the amount of uintaite to 4 or 5 parts may cause significant deterioration of flame intensity.

The new flare composition is easily loaded into customary flare tubes by conventional manufacturing methods and equipment, and has been seen to provide improved flame luminosity whether hand-tamped or mechanically augered into the tube. The improved flare composition burns well even before the anti-dusting agent has been baked off.

It has further been discovered that a flare composition according to the invention ignites at much lower temperatures than conventional flare compositions. In particular, it has been found that it is not necessary to use any primer material at all, the purpose of which is generally to provide a high temperature for a sufficient period of time to ignite the conventional flare compositions.

Figure 2:
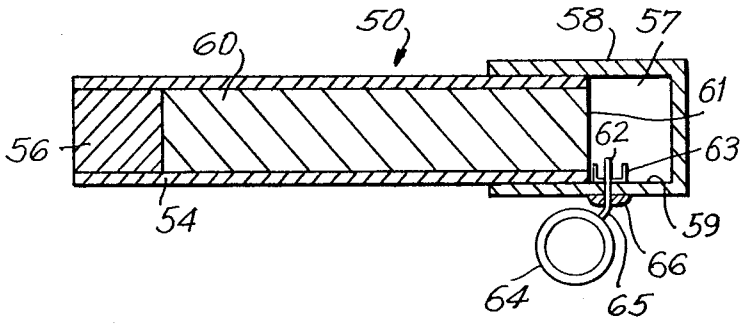
FIG. 2. is a longitudinal sectional view of another preferred embodiment of the present invention.

Thus, another preferred embodiment of the invention is illustrated in longitudinal cross section in FIG. 2. Similarly as described above, the flare 50 includes an improved pyrotechnic composition 60 according to the invention. The flare 50 may comprise a cylindrical tube 54, a plug 56, and a fitted cap 58 arranged to form a watertight enclosure 57 thus completely protecting the composition 60 from inadvertent wetting. In this embodiment, however, the cap 58 includes special features designed to take advantage of the beneficial features of the invention. Here, the cap 58 is seen to include a conventional igniter cup device 62, positioned on an inside wall 59 of the fitted cap 58, so as to cause the igniter cup flame to spread across the face 61 of the flare composition 60.

The igniter cup device 62 may be a conventional red phosphorous igniter, known customarily as a "military match," and may include a metallic cup 63, as is also conventional. A pull string 65 passes through the wall of the cap 58, and may be attached at its external end to a ring 64, or the like, for ease of pulling the cord 65. A drop of sealant 66, such as silicone or waterproof adhesive, may be placed at the spot where the igniter cup string 65 exits the cap 58, so as to maintain the watertightness of the enclosure 57.

It has been found that the heat generated by a conventional igniter cup is sufficient to ignite the flare composition according to the invention, a highly advantageous result not achieved by other signal flares in common use. This novel feature, combined with the arrangement as depicted in FIG. 2, allows for lighting of the flare 50 without the necessity of first opening the watertight enclosure 57 in any way. Once the flare composition 60 ignites, the end cap 58 is simply consumed by the flame. Thus, in a marine emergency, for example, there is little chance that the flare will not ignite, such as is often the case when customary flares become wet.

While especially useful as the pyrotechnic composition in a signal or distress flare, it will be readily understood by those skilled in the art that the novel composition disclosed herein may be used in a variety of pyrotechnic articles, including fireworks and the like. The scope of the invention is limited only by the claims.

What is claimed is:

1. An illuminating non-metallic pyrotechnic composition which comprises, expressed in absolute weight units:

(a) from about 51 to 61 parts of strontium nitrate, (b) from about 15 to 25 parts of potassium perchlorate, (c) from about 15 to 25 parts of sulfur, (d) about 3 parts of sodium nitrate, and (e) about 2 parts of uintaite.

2. The composition of claim 1, further including, at an intermediate stage of manufacture, about 1 to 1½ parts of an anti-dusting agent.

3. The composition of claim 2, wherein the anti-dusting agent is No. 1 diesel.

4. A composition according to claim 1 which is essentially free of other fuel constituents.

5. A composition according to claim 4 wherein said other fuel constituents include at least one of dextrin, nitrocellulose and charcoal.

6. A composition according to claim 1, which consists of about 56 parts of constituent (a), and about 20 parts each of constituents (b) and (c).

7. A composition according to claim 6 which is essentially free of other fuel constituents.

8. A composition according to claim 7 wherein said other fuel constituents include at least one of dextrin, nitrocellulose and charcoal.

9. A pyrotechnic flare comprising:

a tubular casing closed at one end and containing a pyrotechnic composition, said pyrotechnic composition consisting essentially of, expressed in absolute weight units:

(a) from about 51 to 61 parts of strontium nitrate, (b) from about 15 to 25 parts of potassium perchlorate, (c) from about 15 to 25 parts of sulfur, (d) about 3 parts of sodium nitrate, and (e) about 2 parts of uintaite.

10. A flare according to claim 9, wherein said pyrotechnic composition further includes, at an intermediate stage of manufacture, about 1 to 1½ parts of an anti-dusting agent.

11. A flare according to claim 10, wherein the anti-dusting agent is No. 1 diesel.

12. A flare according to claim 9 wherein said pyrotechnic composition is essentially free of other fuel constituents.

13. A flare according to claim 12 wherein said other fuel constituents include at least one of dextrin, nitrocellulose and charcoal.

14. A flare according to claim 9, further comprising a cap on the other end of said tubular casing.

15. A flare according to claim 14, wherein said cap includes means for igniting said pyrotechnic composition.

16. A flare according to claim 15, wherein said means for igniting said pyrotechnic composition comprises an igniter cup positioned on an inside wall of said cap so as to cause a flame across a surface of said pyrotechnic composition.

17. A flare according to claim 9, wherein said pyrotechnic composition consists of about 56 parts of constituent (a), and about 20 parts each of constituents (b) and (c).

18. A flare according to claim 17 wherein said pyrotechnic composition is essentially free of other fuel constituents.

19. A flare according to claim 18 wherein said other fuel constituents include at least one of dextrin, nitrocellulose and charcoal.

* * * * *